United States Patent [19]

Scripter

[11] Patent Number: 4,705,310

[45] Date of Patent: Nov. 10, 1987

[54] WASTE COLLECTION DEVICE

[76] Inventor: Robert D. Scripter, 3034 S. 38th St., Ste. 2, Phoenix, Ariz. 85040

[21] Appl. No.: 884,612

[22] Filed: Jul. 11, 1986

[51] Int. Cl.[4] ..... A01K 29/00

[52] U.S. Cl. ..... 294/1.4; 15/257.7

[58] Field of Search ..... 294/1.1, 1.3–1.5, 294/19.1, 55, 57; 15/257.1, 257.2, 257.4, 257.7; 248/95, 99, 101

[56] References Cited

U.S. PATENT DOCUMENTS

| | | | |
|---|---|---|---|
| 1,865,724 | 4/1928 | Way | 248/101 |
| 3,716,263 | 2/1973 | Gatti | 294/1.4 |
| 4,012,067 | 3/1977 | Travis | 294/1.4 |
| 4,048,691 | 9/1977 | Spangler | 294/1.4 X |
| 4,138,153 | 2/1979 | Brown | 294/1.4 |
| 4,221,415 | 9/1980 | Ganz | 294/1.4 |
| 4,341,410 | 7/1982 | Summach | 294/1.3 |
| 4,349,224 | 9/1982 | Shiozaki | 294/1.4 |
| 4,500,125 | 2/1985 | Olson | 294/1.4 |

*Primary Examiner*—Johnny D. Cherry
*Attorney, Agent, or Firm*—Gregory J. Nelson

[57] ABSTRACT

A waste collection device for animal waste having an elongate tubular handle with a flexible frame at the lower end. The frame supports a removable plastic bag which bag is disposed of when the collection procedure is completed. A clip permits various sized plastic bags to be retained on the frame. In one embodiment the frame may be used as a short hand-held scoop-like device independent of the tubular handle.

6 Claims, 6 Drawing Figures

FIG. 5
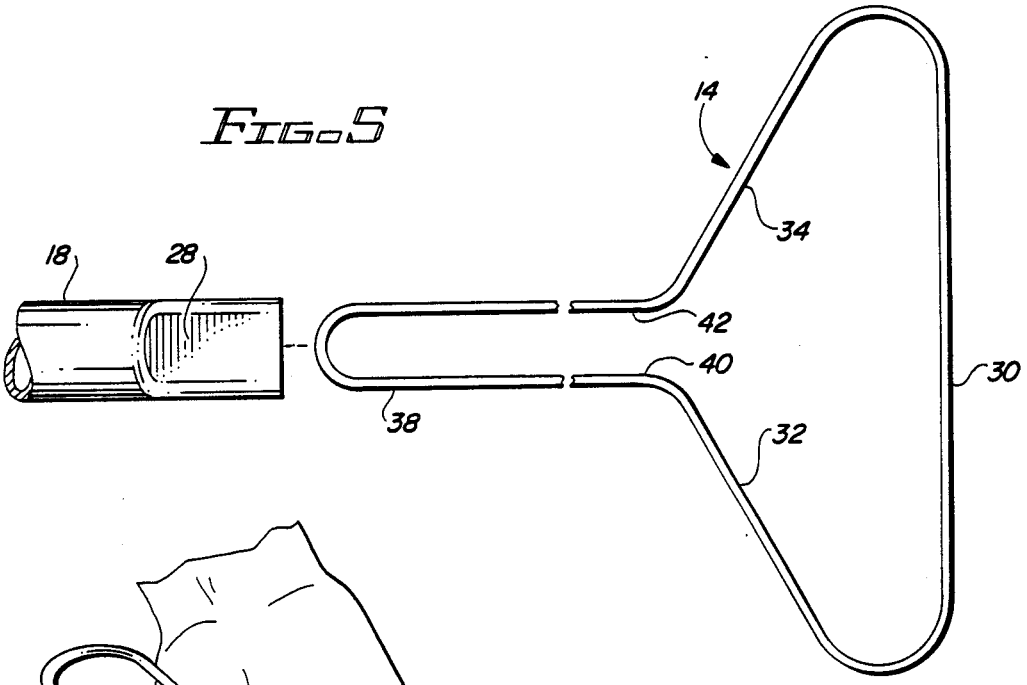
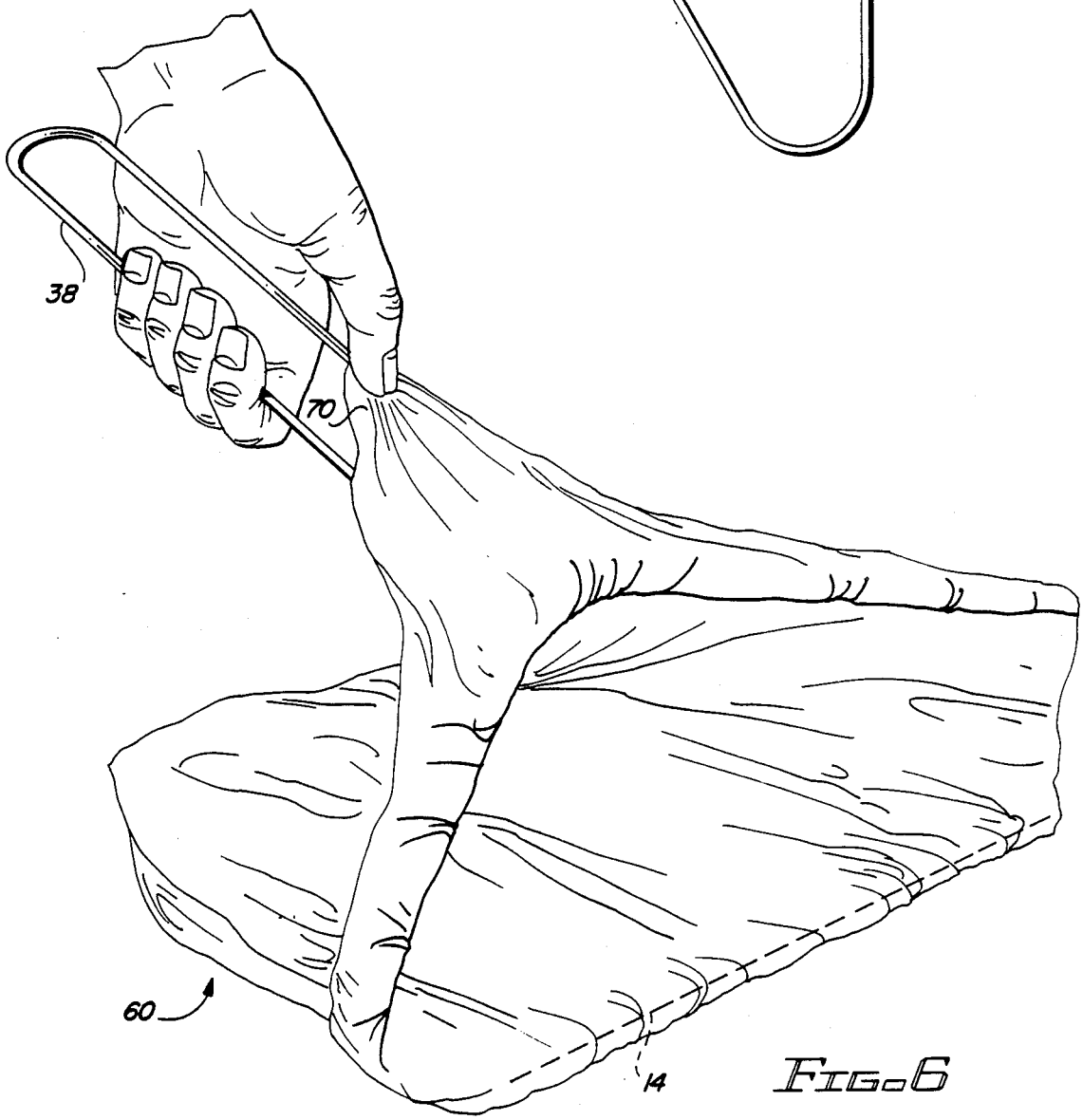
FIG. 6

WASTE COLLECTION DEVICE

The present invention relates to a waste collection device and more particularly to a device for the collection of waste such as animal litter within a disposable receptacle.

The waste or refuse left by domestic animals and pets is unsightly and more importantly often presents a health hazard. Accordingly, many governmental subdivisions have passed strict ordinances which require pet owners to collect and properly dispose of the litter. Various types of sanitary disposal devices have been developed in an attempt to provide an efficient and convenient implement for this purpose which permits the pet owner to collect the refuse without directly contacting the refuse and which facilitates sanitary disposal of the refuse.

Typical prior art devices are described in the following U. S. Patents:

U.S. Pat. No. 3,659,891 shows a refuse collecting device having a tubular bag mounting member at the lower end of the handle for collecting refuse. The refuse is collectable in a disposable bag removably mounted on a tubular element by a retention collar.

U.S. Pat. No. 4,021,994 shows a device for removing animal droppings which device has a folding handle secured to a rim to support the open edge portion of a disposable bag. The bag is held in place by a hinged bag clamp. The bag has a lip portion which extends outwardly and away from the bag clamp to faciliate scooping of material into the bag.

A somewhat similar device for the collection of canine waste is shown in U.S. Pat. No. 4,221,415. The apparatus shown in this patent has pivotally connected first and second frame elements which retain a disposable sanitation sheet such as a paper towel in position. The first frame member is rotationally displaceable with respect to the second member for enveloping waste contents within the sheet. An elongate handle is attached to the second frame member for manipulating the apparatus.

U.S. Pat. No. 3,757,737 shows a device for picking up animal droppings which has a frame for holding a bag in an open position near the lower end of the handle. A removable paddle is arranged to propel the waste into the bag. The movement of the paddle is remotely controlled at the upper end of the handle.

U.S. Pat. No. 4,500,125 shows a pet waste collecting device with a handle having a frame at one end to support a plastic bag. The bag is secured at hook means at the junction of the frame and the handle. Telescopically and detachably fitting within the tube is a scoop.

Devices such as those represented by the aforementioned patents do render the task of collection of animal waste less offensive. However, devices such as those with movable paddles or scoops are often cumbersome and difficult to use. Further, devices which use throw-away receptacles such as plastic bags often provide inconvenient ways of attaching the bag or which are difficult for the owners to use or which require the user to come into contact with the waste or with a portion of the device which has been in contact with the animal waste.

Accordingly, it is an object of the present invention to provide an efficient, light-weight waste collection device which detachably supports plastic receptacles such as polymeric bags of various sizes and shapes for collecting the waste for disposal. The device permits the user to use the holder in conjunction with a short handle or with a longer handle so that the user can maintain a substantially upright position while manipulating the device and avoid excessive stooping and bending.

Another object of the present invention is to provide a waste collection device in which the frame-like holder is detachable from an elongate handle for use separate and apart from the tubular handle.

Another object of the present invention is to provide a waste receptacle device having a flexible frame or holder which supports a plastic receptacle which frame and holder is flexible to assist the user in scooping waste material into the attached bag.

Still another object of the present invention is to provide a waste collection device which detachably supports disposable bag such as polymeric bags and which will accommodate a wide variety of size and shapes of bags such as sandwich bags, small shopping bags and other bags which may be collected by the user and in turn used in conjunction with the invention.

The above and other advantages and features of the collection device of the present invention will be understood from consideration of the following description, claims and accompanying drawings in which preferred adaptations of the invention have been illustrated with the various elements identified by appropriate reference characters in each of the views in which:

FIG. 5 is a plan view of the lower end of the extension handle and the frame holder in a position removed from the extension handle; and FIG. 6 is a perspective view illustrating the use of the frame holder in conjunction with a collection bag separate from the extension handle.

Figure 1:
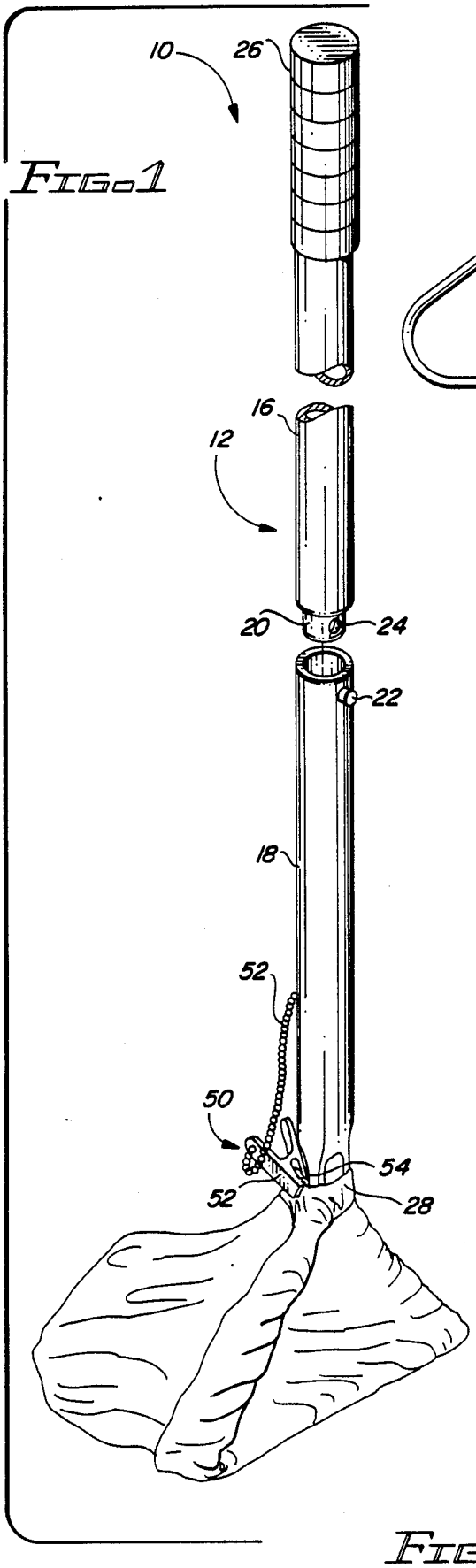
FIG. 1 is a perspective view of the waste collection receptacle of the present invention showing a collection receptacle attached the frame holder.

Turning now to the drawings, the pet litter collecting device of the present invention is generally indicated by the numeral 10 and includes an elongate tubular handle 12 having a generally triangular-shaped flexible frame member or holder 14 at the lower end. The tubular handle 12 includes an upper section 16 and a lower section 18. A reduced diametral section 20 is provided at the lower end of handle section 16 and is receivable within the upper end of section 18. Upper section 16 and lower section 18 of the handle may be locked together for use by a detent 22 which is engageable within a bore or recess 24 in section 20. The upper end of the extension handle section 16 is provided with a grip 26 of rubber or plastic for the comfort of the user and to provide a better grasp of the device for manipulation. The tubular handle may be constructed from any suitable material but is preferably formed of one inch O. D. heavy walled aluminum tubing. The lower end of section 18 is partially crimped at 28 and receives the flexible frame or holder 14 as will be explained below.

Figure 2:
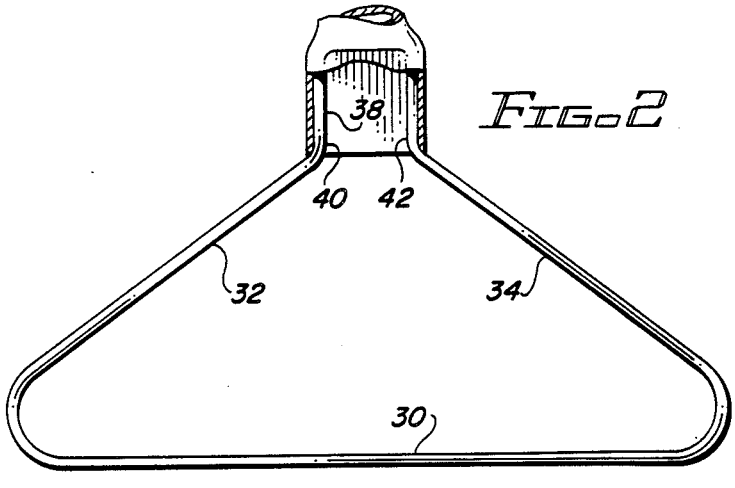
FIG. 2 is a plan view of the frame holder at the lower end of the extension handle with a portion of the handle broken away.

The flexible frame or holder 14, as best seen in FIG. 2, is generally triangular in shape having a base section 30 and opposite converging sides 32 and 34. Sides 32 and 34 are provided with an extension 38 at their upper end which forms a handle portion which is received within the lower end 28 of section 18 of the handle. The extension 38 includes two generally parallel spaced apart members 40 and 42 which are spaced apart a distance corresponding to the interior diameter of section 28 so that an interference fit exists. Thus, the unitary holder or frame can be inserted in the lower end of the handle and is removably secured to the handle. The extension or projection 38 will also serve as a handle for use of the frame or head as a hand-held scoop device separate from the extension handle as will be explained. The frame or head is preferably formed from a suitable wire such as approximately 3/16 O.D. aluminum or steel wire having flexibility. The inherent flexibility of the material will assist the user in scooping the material into the receptacle retained by the holder.

Typically, the length of each of the separable sections 16, 18 of the extension handle is about twelve to twenty-four inches. Similarly, the dimensions of the triangular frame are selected so that each of the sides is approximately eight to twelve inches in length. In this way, the device is easily usable by most individuals and may be used by the individual in an upright position with minimum of bending or stooping in conjunction with the extension handle. If the user desired, the head or frame 14 can be removed and be used separately for better control and manipulation.

Figure 3:
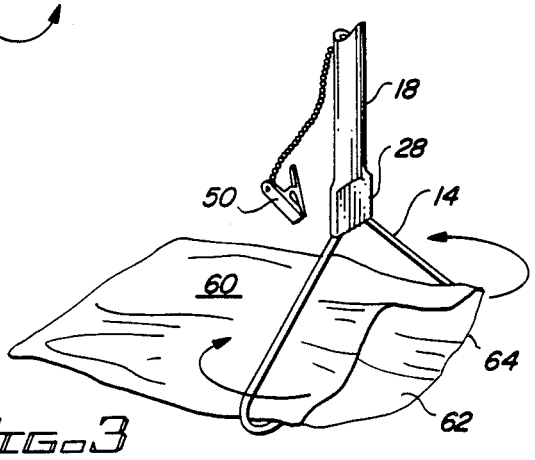
FIG. 3 is a perspective view illustrating the initial step of inserting a disposable bag in the frame holder.
Figure 4:
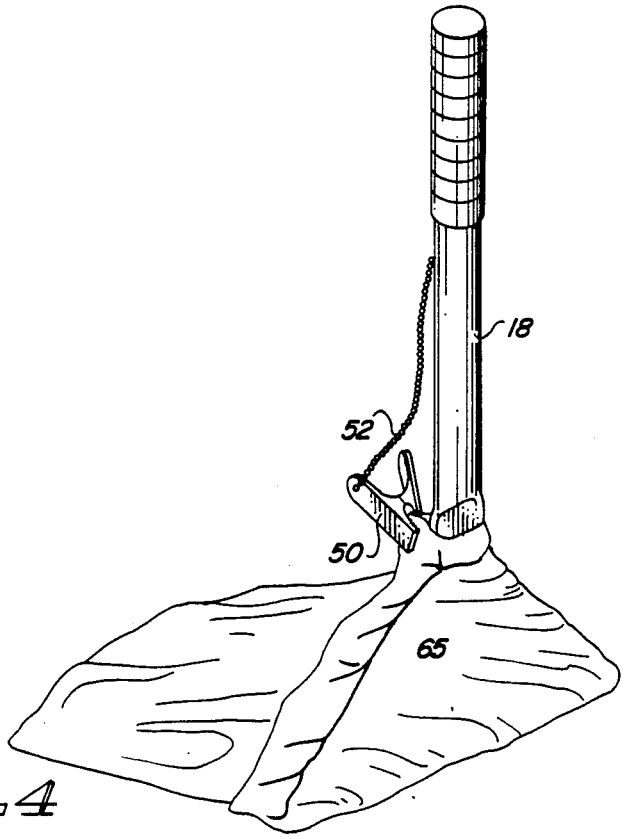
FIG. 4 is a view similar to FIG. 3 illustrating the bag in a secured position.

As best shown in FIGS. 3 and 4, the device is designed to be used with a receptacle such as plastic bags of various sizes and shapes. In this way, the user may collect plastic bags from supermarkets and department stores which are variously sized and shaped and these may be used with the device of the present invention. Similarly, small waste disposal and sandwich bags may also be used. Thus, the user is provided the advantage that no special bag need be purchased for use in conjunction with the device.

To facilitate the attachment of bags of various sizes and shapes, a fastener 50 is secured by a flexible wire or bead chain 52 adjacent the lower end of handle section 18. The fastener 50 may be a conventional spring clip having jaw members 52 and 54 which are spring biased to a closed position and may be opened by application of manual pressure to the handle ends of the clip section.

As best seen in FIGS. 3 and 4 a suitable bag 60, such as a bag of plastic or paper, is partially inserted through the opening defined by the flexible frame or holder. With the bag in position as shown in FIG. 3, the opening 62 of the bag is entirely within the frame and the open edge 64 of the bag is spaced an inch or two in front of the frame. The leading edge 64 of the bag is then reversely bent as shown in FIG. 4 forming a cuff 65 whch overlays the frame 14. Loose bag material can then be manually gathered in the general location at the back of the handle section 18 near its lower end and gathered and secured by the fastener 50. Since the fastener is of the clip-type and is secured to the handle by a chain or wire, the user is provided substantial flexibility in the positioning of the clip and therefore a wide variety of sizes and shapes of bags may be used with the device.

With the device assembled as shown in FIG. 1, the operation of the device is convenient for the user. The extension handle allows the user to collect refuse in a standing position with a minimum of bending or stooping. The flexible frame assists the user in directing material into the bag. When so used, the material is collected in the bag and when the bag or receptacle is ready for disposal, the user simply unfastens the bag at fastener 50 and disposes of the bag along with it's contents. Note that the frame 14 is protected from contact with the waste material by the cuff 65 so that the user does not need to come into contact with any portion of the device that may be rendered unsanitary by contact with waste material.

In the event the user wishes to achieve better manipulation of the device, the frame 14 may be withdrawn from the lower end of the handle section 18 by manually exerting an axial separating force as seen in FIG. 5. The user may use the flexible frame head as a short handled scoop as best shown in FIG. 6 by grasping the extension 38.

Again, the bag 60 is inserted through the frame and reversely bent forming a cuff. Use in this manner will allow the user to simply manually hold the bag in place by pinching a section of the bag 70 beneath the thumb of the user and the extension 38 as best shown in FIG. 6.

It will be apparent the user may also, if desired, use only the lower handle section 18 in connection with the holder or frame head if this is more convenient. The upper section 16 may be easily and conveniently attached or detached at the detent 22 as desired.

Thus, it will be seen that the present invention provides an animal waste collection apparatus which achieves the various objects of the present invention and is convenient and efficient to use. It will be obvious to those skilled in the art to make various changes, alterations and modifications to the device described herein. To the extent these various alterations, modifications and changes do not depart from the spirit and scope of the appended claims, they are intended to be encompassed therein.

I claim:

1. A waste collection apparatus for use with a dispoxable, flexible receptacle having an opening defined by an edge, said apparatus comprising:

(a) an elongate handle having a lower end defining an axially extending recess therein;

(b) a holder having a base and sides and defining a frame for receiving said receptacle therein, said holder including an integrally formed extension detachably and frictionally securable in said recess wherein said holder may be manually used independent of said elongate handle with the user grasping said extension; and (c) fastener means tethered to said handle by flexible attachment means wherein the edge of said receptacle can be reversely folded over said frame and gathered to detachably secure said receptacle to said frame by securement of said fastener means to said receptacle for manual collection of waste in said receptacle.

2. The waste collection apparatus of claim 1 wherein said elongate handle includes at least a first and second member detachably secured at locking means.

3. The waste collection apparatus of claim 1 wherein said fastener means comprises a clip having jaws normally spring biased to a closed position.

4. The waste collection apparatus of claim 1 wherein said holder is integrally formed from flexible wire.

5. The waste collection apparatus of claim 4 wherein said holder is generally triangular in shape.

6. The waste collection apparatus of claim 1 wherein said elongate handle is provided with a grip at its upper end.

* * * * *